US005524309A

United States Patent [19]

La Barbera

[11] Patent Number: 5,524,309

[45] Date of Patent: Jun. 11, 1996

[54] BEACH TOWEL TIE DOWN PINS

[76] Inventor: V. Gail La Barbera, P. O. Box 3, Lake Zurich, Ill. 60047

[21] Appl. No.: 367,850

[22] Filed: Jan. 3, 1995

[51] Int. Cl.[6] ..... A47C 31/00; E04H 15/62

[52] U.S. Cl. ..... 5/658; 5/417; 135/118

[58] Field of Search ..... 5/417, 658; 248/545; 135/118

[56] References Cited

U.S. PATENT DOCUMENTS

| | | | |
|---|---|---|---|
| 2,840,092 | 6/1958 | Hill | 5/417 |
| 2,939,468 | 6/1960 | Boyce | 5/417 |
| 3,032,780 | 5/1962 | Stroup | 5/658 |
| 3,241,202 | 3/1966 | Knauft | 5/417 |
| 3,431,924 | 3/1969 | Simpson | 135/15 |
| 3,935,653 | 2/1976 | Klein | 5/417 |
| 4,063,333 | 12/1977 | Schweitzer | 24/137 A |
| 4,145,793 | 3/1979 | Berlet | 24/137 A |
| 4,432,382 | 2/1984 | Wolf | 125/118 |
| 4,699,165 | 10/1987 | Barzana | 5/417 |
| 4,905,718 | 6/1990 | Vandiver | 135/118 |
| 4,914,767 | 4/1990 | Balicki et al. | 5/417 |
| 4,927,118 | 5/1990 | Pierorazio | 5/417 |
| 5,245,715 | 9/1993 | Dinkins | 5/417 |
| 5,327,922 | 7/1994 | Deroche | 5/417 |
| 5,390,890 | 2/1995 | Ferguson et al. | 5/417 |

*Primary Examiner*—Michael J. Milano

*Attorney, Agent, or Firm*—David L. Baker; Rhodes & Ascolillo

[57] ABSTRACT

The invention is a ground spike for securing ground covers, including beach towels and blankets in place. The invention consists of a pointed stake with longitudinal channels and a cap containing a pair of oppose spring biased arms that pivot and end in oppose jaws with serration for gripping a towel or blanket. An area on the surface of the cap contains grooves for ease in gripping the cap during insertion and removal from the ground.

2 Claims, 3 Drawing Sheets

FIG. 2
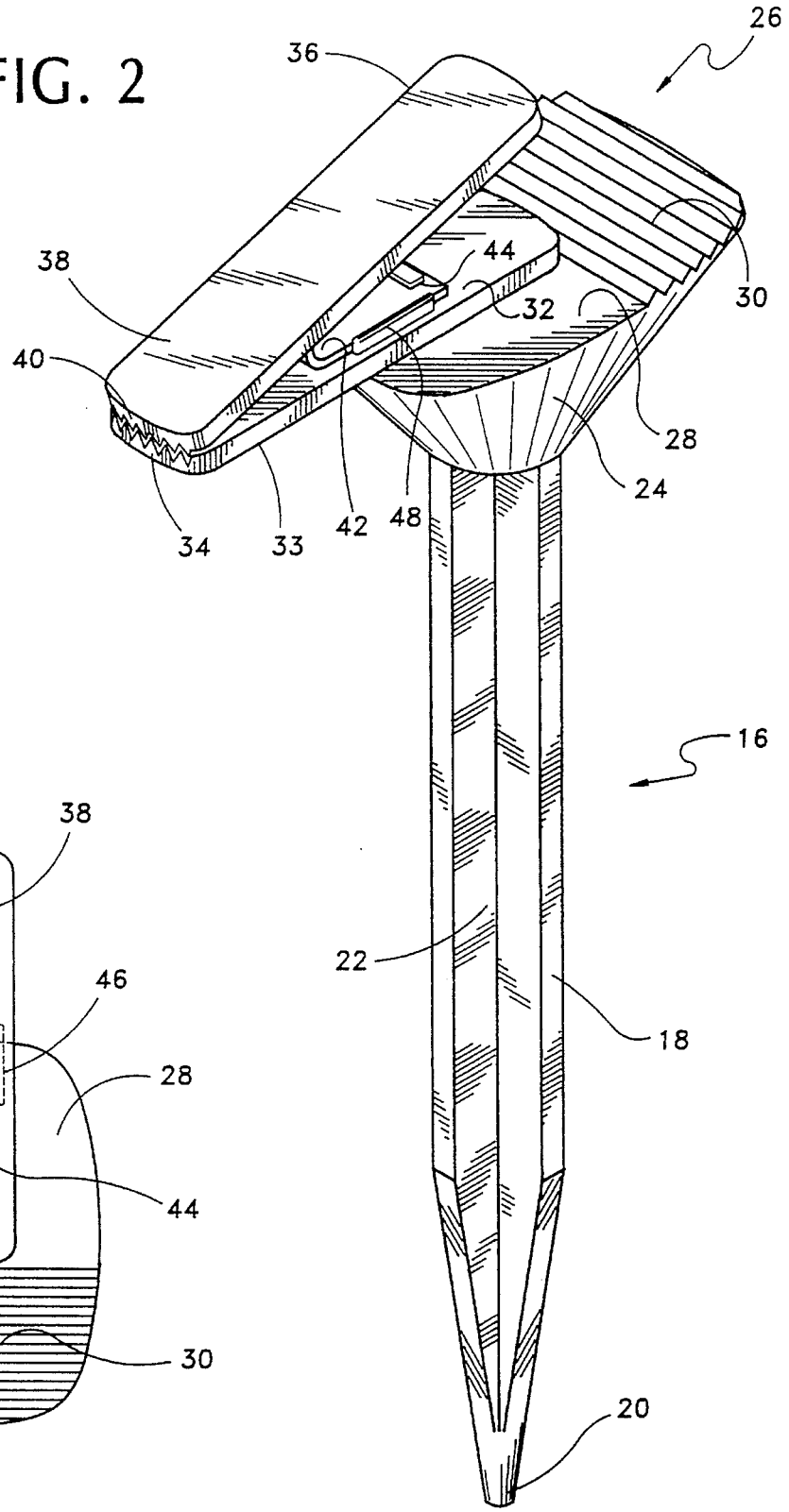
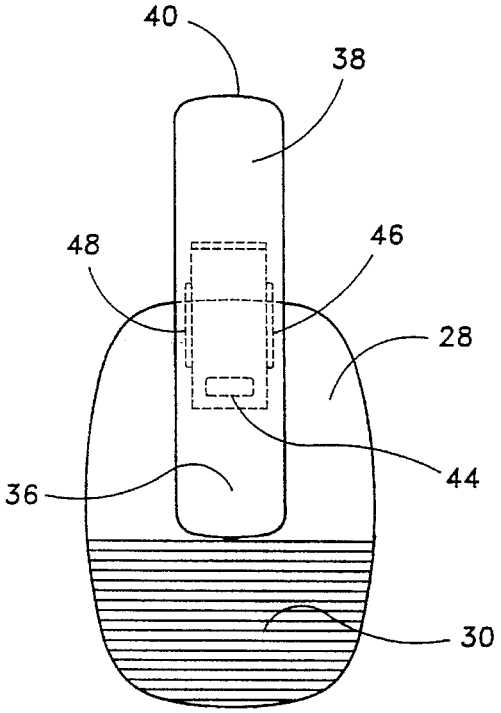
FIG. 3

BEACH TOWEL TIE DOWN PINS

BACKGROUND OF THE INVENTION

1. Field of the Invention

The invention relates generally to a ground fastener for flexible material and more particularly to a tie down for beach towels.

2. Description of the Prior Art

Regardless of whether one is at an ocean beach with the on-shore breeze or the off-shore breeze or at a lake in the mountains where the white fair weather clouds create cyclonic wind currents, the same question arises when the blanket is put on the sand, will it be there when your ready to sit down? Pre-emptively, most beach goers simply pile quantities of items on each corner of the towel and hope for the best. The problem is not so easily solved where the beach goer is alone or with a large family needing six or seven towels to stake out their turf. There are only so many coolers and radios that can be realistically taken to the beach. The disclosed invention is a simple anchoring tool for beach towels or other flexible material needed to be secured at ground level.

Numerous anchoring devices have been disclose over the years and include everything from anchors for radio towers to anchors for tents. Nothing in the prior art of which Applicant is aware anticipates the anchor disclosed herein and claimed in the appended claims. For example, U.S. Pat. No. 3,431,924 issued Mar. 11, 1969 to Simpson disposes a tent stake that includes a circular head 10 for engaging a rope and further includes a snap on blade (FIGS. 5 and 6) to be used in loose soil. U.S. Pat. 4,432,382 issued Feb. 21, 1984 to Wolf discloses another form of tent stake that includes a hook and a driving surface. U.S. Pat. No. 4,905, 718 issued Mar. 6, 1990 to Vandiver discloses another tent stake that includes an elongated rod with an eyelet at the top through which a guy wire or rope may be threaded. Two U.S. patents disclose typical clothespins designed to grasp and hold items placed between their jaws. One disclosure includes a flat metal spring biasing the jaws closed. These inventions are disclosed in U.S. Pat. No. 4,145,793 issued Mar. 27, 1979 to Berlet and U.S. Pat. No. 4,063,333 issued Dec. 20, 1977 to Schweitzer.

SUMMARY OF THE INVENTION

The invention is directed to a means for anchoring flexible material to the ground of the proximity of the ground. The invention consists of a stake tapered to a point on one end for insertion into the ground and further having at least four channels along the shaft which is attached to the sloping surfaces of a cap. The stake is off set from the center of the cap which,in top view, is a truncated ellipsoid with rounded corners. The top surface of the cap is flat with a grooved area at one end to facilitate insert, ion of the stake into the ground. The opposed end of the top surface contains a pair of jaw members that are connected to each other by a flat metal spring and move about an imaginary pivot created by the spring. The jaws, at the end distal from the cap, are serrated and normally closed and grasp the blanket or other material. One arm of the jaws is attached to the cap while the other arm is free to move against the bias of the spring to open and close the jaws.

It is therefore an object of the invention to provide a new and improved ground cover tie down.

It is another object of the invention to provide a new and improved ground cover tie down that is quick and simple to use.

It is a further object of the invention to provide a new and improved ground cover tie down that is low in cost.

It is still another object of the invention to provide a new and improved tie down for beach blankets and towels that is easy to carry.

It is still a further object of the invention to provide a new and improved tie down for ground covers that is of a durable and reliable construction.

It is another object of the invention to provide a new and improved tie down for ground covers that may be easily and efficiently manufactured and marketed.

There, together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a perspective view of the invention.

FIG. 3 is a top plan view of the invention.

DETAILED DESCRIPTION OF A PREFERRED EMBODIMENT

Figure 1:
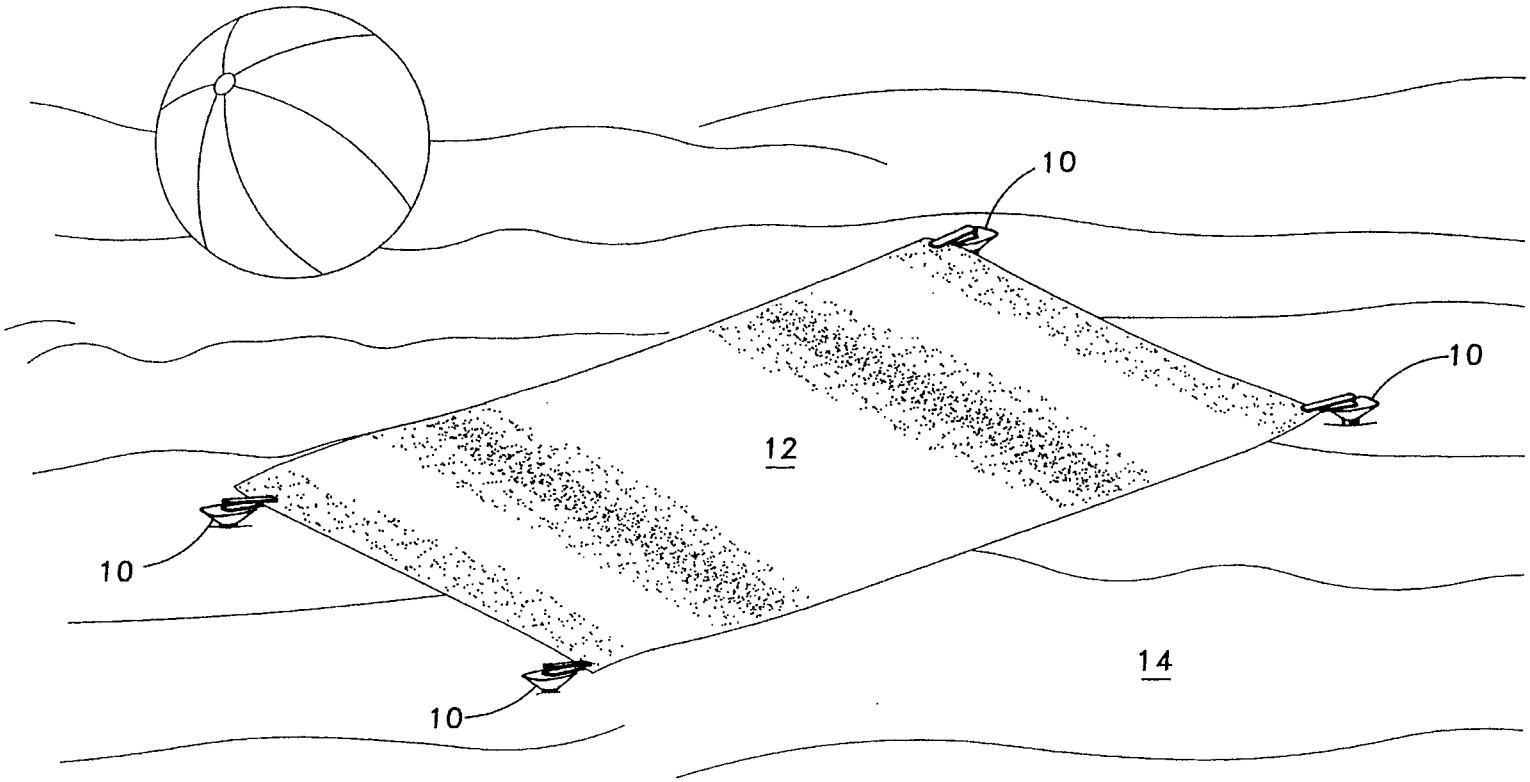
FIG. 1 is an environmental view of the invention holding a beach towel.

Referring now to FIG. 1, the invention is shown at 10 securing the corners of a beach towel 12 in the sand 14.

Concerning FIGS. 2 and 3, the blanket anchor of the invention, formed of molded high density plastic or similar material, and is shown generally at 16, with a shaft 18 that ends in a generally pointed tip 20. The shaft 18 contains four equally spaced channels 22 around the primary axis of the shaft and engages the sloping sides 24 of the cap shown generally at 26. The surface plane of the cap 28 is viewed as a truncated ellipsoid with rounded corners. One end of the cap surface 28 contains an area of groves 30, allowing the user to grip the cap when installing or removing the anchor from the ground. Molded into or otherwise mechanically affixed to the surface 28 is a first arm 32 which extends beyond the edge of the cap surface and ends as a jaw member 33 having a serrated end edge 34. A second arm 36, ending in jaw 38 with serration 40, is mated to serration 34. Second arm 36 is connected in a pivoting relationship with the first arm 32 and jaw 33 by a fiat metal generally U-shaped spring 42. The spring has an aperture proximate each end that engages a post 44 located in each arm and centered by ridges 46, 48 located on each arm. Application of a downward force to second arm 36 will cause second arm 36 to pivot, opening jaw 38.

Figure 4:
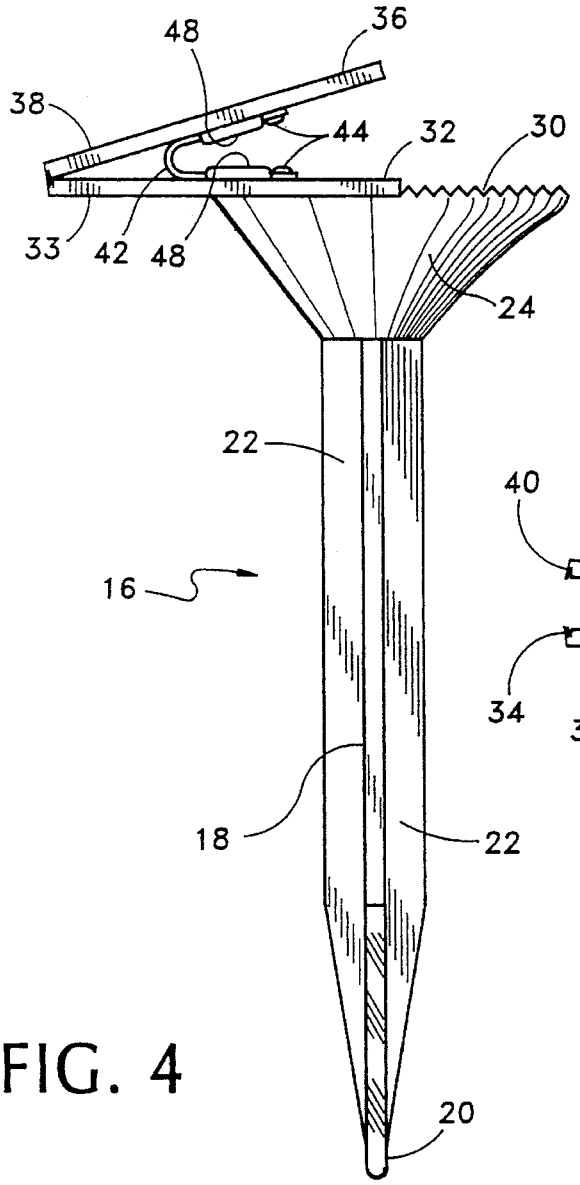
FIG. 4 is a left side elevation view of the invention with jaws closed.
Figure 5:
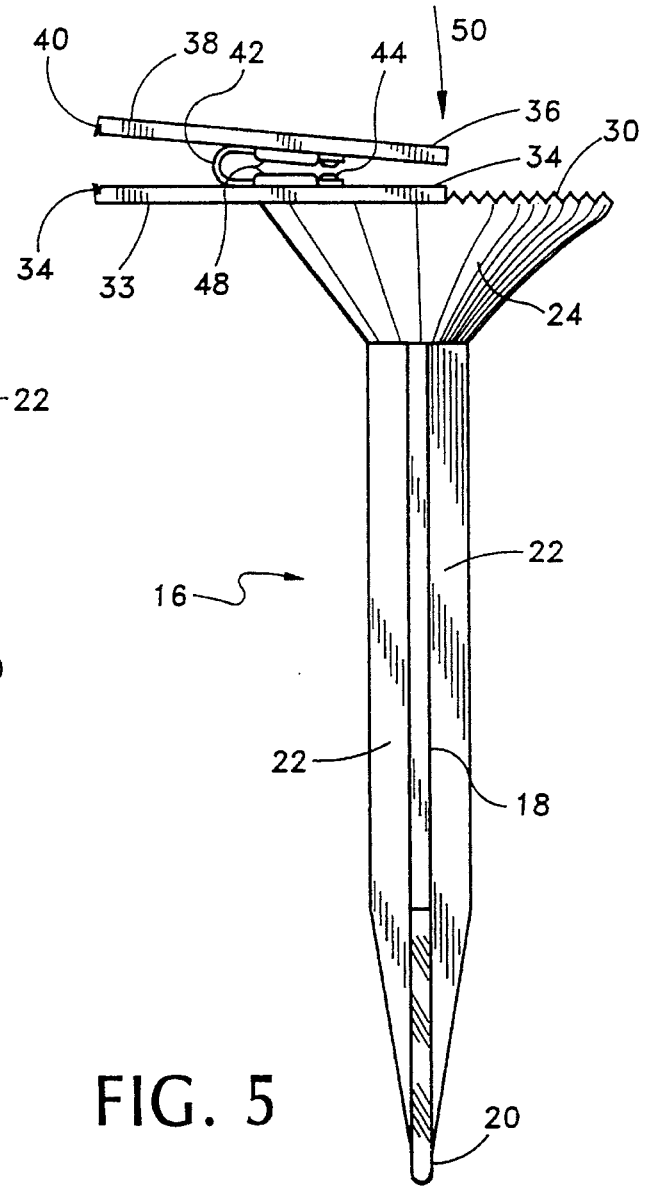
FIG. 5 is a left side elevation view of the invention with jaws open.

Regarding FIGS. 4 and 5, FIG. 4 shows the invention a passive condition as for example when the tie down is unused or when it might have a towel or blanket in its grasp. No force is applied to the arm 36. FIG. 5 shows the invention with a force represented by arrow 50 applying a downward force to arm 36, separating the jaws 33,38 and the serration 34,40. In this position the invention is ready to accept a towel or blanket for anchoring.

It should be understood, of course, that the foregoing disclosure relates to only a preferred embodiment of the invention and that numerous modifications or alterations may be made therein without departing from the spirit and scope of the invention as set forth in the appended claims.

What is claimed is:

1. A device for facilitating the tieing down of a ground cover comprising:

a stake means for inserting into soil about the perimeter of the area to be covered;

said stake means is tapered to a point at one end;

said stake means contains a plurality of channels;

said channels follow the primary axis of the stake;

a shaped cap on the stake remaining above the surface of the ground; and means, located on and attached to the said cap, for engaging and holding the ground cover;

said means for engaging and holding include a pair of mating, opposed jaw members and a spring attached to the jaw members;

said spring is a fiat metal U-shaped spring;

said opposed jaw members include serrated matching surfaces for grasping a ground covering material;

said opposed jaw members are spring biased together; and an area of grooves located on the surface of said cap proximate the means for engaging and holding the ground cover.

2. A device for facilitating the tieing down of a ground cover according to claim 1 wherein there are four channels.

* * * * *